United States Patent [19]

Brauer et al.

[11] 4,331,959

[45] May 25, 1982

[54] METHOD AND APPARATUS FOR DETECTING A DEFECTIVE OBJECT ON A LANE OR TRACK

[75] Inventors: Juergen Brauer; Wolf-Dieter Schuck, both of Neubiberg, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 142,857

[22] Filed: Apr. 21, 1980

[30] Foreign Application Priority Data

May 5, 1979 [DE] Fed. Rep. of Germany ..... 2918178

[51] Int. Cl.[3] ..... H01Q 17/00; B61L 3/00

[52] U.S. Cl. ..... 343/18 A; 191/10; 246/187 C

[58] Field of Search ..... 246/169 D, 178, 187 C; 340/47, 48, 52 H; 343/18 A; 191/10

[56] References Cited

U.S. PATENT DOCUMENTS

| | | | |
|---|---|---|---|
| 2,898,561 | 8/1959 | Hayes | 343/18 A |
| 3,293,581 | 12/1966 | Joyce | 191/10 X |
| 3,365,572 | 1/1968 | Strauss | 246/187 C |
| 3,408,646 | 10/1968 | Simon et al. | 343/6.5 SS |
| 3,410,996 | 11/1968 | Carrino | 246/187 C |
| 3,919,686 | 11/1975 | Narbaits-Jaureguy | 343/6.5 R X |

*Primary Examiner*—Malcolm F. Hubler

*Attorney, Agent, or Firm*—W. G. Fasse; D. H. Kane, Jr.

[57] ABSTRACT

A defective object such as a vehicle normally movable on a lane, assembly line, or track is detected by a receiver on another object travelling behind the defective object, to avoid rear end collisions with the defective vehicle. For this purpose the vehicles are equipped with a signal receiver and with a signal damping member. The signal is transmitted in a transmission line extending along the lane, assembly line, or track. When a defect occurs, the damping member is moved into a position relative to the transmission line in which the damping member sufficiently dampens the signal so that the next following vehicle fails to receive the signal whereby a warning may be provided that the path ahead is not free or that it is blocked.

11 Claims, 2 Drawing Figures

Fig.1
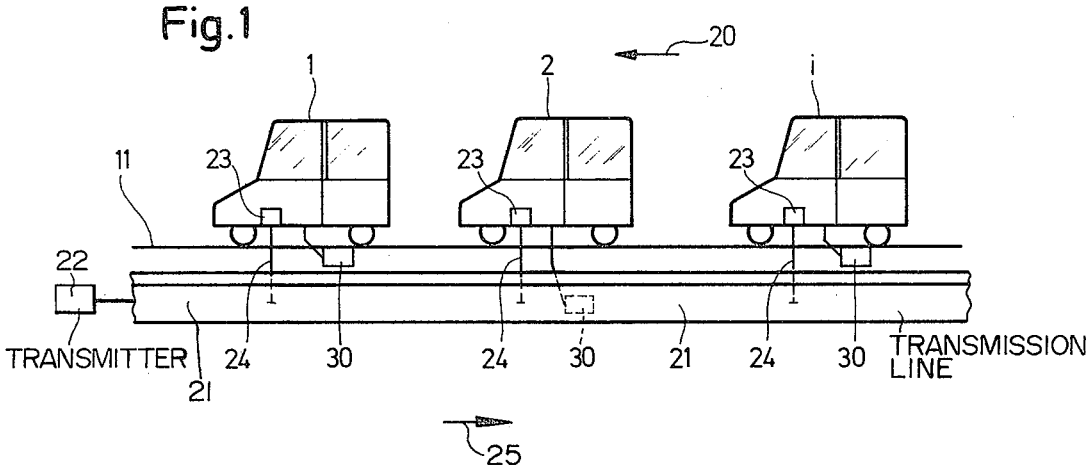
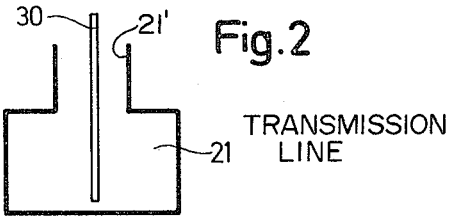
Fig.2

METHOD AND APPARATUS FOR DETECTING A DEFECTIVE OBJECT ON A LANE OR TRACK

BACKGROUND OF THE INVENTION

The invention relates to a method and apparatus for detecting a defective object among a plurality of objects travelling along a fixed path in a given travel direction. Such objects, for example vehicles, are bound to travel along the same lane or track, for example, in a passenger transportation system. The travelling objects may also be machine components on a machine tool or on an assembly line or the like.

It has been necessary to increase the traffic density of the individual track sections in order to satisfy the increasing requirements regarding the conveying capacity and the travelling speed of modern, track bound public transportation systems. Under such operating conditions it is essential that vehicles present on the same path section and travelling on the same lane or track are recognized in time to avoid collision.

For this purpose position locating systems have been developed to an increasing extent. In such position locating systems the individual objects such as vehicles emit signals which are received by the next following object or vehicles. In such a system, if a following vehicle does not receive a signal, such condition is interpreted as a line clear signal for the path section just ahead.

In automatic, track bound passenger traffic with very short time spaces between succeeding trains or vehicles travelling at high speed it is absolutely necessary to recognize defective vehicles in time in order to avoid accidents by preventing a collision by means of a rapid braking action. All prior art methods and devices are not quite suitable for recognizing defective, track bound objects or vehicles in a fail-safe manner. The fact that prior art systems cannot operate in a fail-safe manner is due to the function principle inherent in prior art systems. For example, the absence of a signal is not an absolutely safe indication that the path section next ahead is free because the signal may be absent due to the fact that the defective vehicle does not transmit its signal. Thus, a collision between a disabled vehicle and the next following vehicle is quite possible under such an operating condition.

OBJECTS OF THE INVENTION

In view of the above it is the aim of the invention to achieve the following objects singly or in combination:

- to provide a method and apparatus for performing the method which is capable of timely recognizing a defective vehicle on a track section even if the traffic density is high and the individual trains or vehicles travel at high speeds;
- to make sure that the absence of a signal positively signifies that there is a defective vehicle on the track ahead;
- to provide a safe, trouble-free transmission under normal operating conditions which transmission is positively interrupted by a defective vehicle; and
- to provide a good transmission quality so that signal interferences will not be able to signify a defective condition on a track or track section.

SUMMARY OF THE INVENTION

According to the invention there is provided a method for the fail-safe recognition of a defective object on a path which is characterized in that a linear transmission medium is arranged along the lane or track and that one or several signals are transmitted through the transmission medium. In case an object or vehicle becomes defective on the lane or track, a signal flow barrier is coupled into the transmission medium, preferably for damping the signal transmission so that a following object cannot receive the signal which normally positively signifies the fact that a track section is free. The transmission through the transmission medium is in a direction opposite to that of the travel direction and the reception, or rather the receivers for such reception, are located downstream of the point of feeding the signal or signals into the transmission medium. Preferably, the lane or track is divided into several sections which are independent of each other as far as the signal transmission is concerned.

According to the present method a fail-safe recognition of a defective vehicle is assured by the passive damping of the signal in response to the fact that a vehicle or object becomes defective. Such damping is accomplished by damping means carried by each vehicle individually. The signal is transmitted in said linear transmission medium extending in parallel to the lane or track, but interrupted when the damping is effective.

The invention has the advantage that the absence of a signal is always recognized as a "busy" condition on the track ahead regardless whether the absence of the signal is caused by the above mentioned damping through the damping means carried on the vehicle or whether the absence of the signal is caused by a technical defect not related to the vehicle on the track. Such absence of a signal may signify that the entire track or a section thereof is "busy".

According to the invention there is further provided an apparatus for performing the above method according to which the transmission medium is a slotted hollow conductor (wave guide), the slot of which extends in parallel to the lane or track and that the signal flow barrier comprises a plate which dips into the longitudinal slot in the slotted hollow conductor so that the object such as a vehicle or a signal receiver at the end opposite the signal transmitter may normally receive the signal through a coupling probe also immersed into the slotted hollow conductor. Preferably, the plate which acts as a signal flow barrier is made of electric or electrically absorbing material such as copper, aluminum, or the like.

The construction of the transmission medium as a slotted hollow conductor makes sure that the transmission is safe and substantially free of interference while simultaneously providing a good transmission quality of the signals. Additionally, the hollow conductor has the advantage that any radiation that may escape the conductor to become an interfering radiation with regard to other systems, is so small that it may be disregarded for practical purposes. Subdividing a path such as a lane or track into several sections has the advantage that each section may be provided with its own signal supply, whereby the present apparatus may be utilized in an economic manner.

BRIEF FIGURE DESCRIPTION

In order that the invention may be clearly understood, it will now be described, by way of example, with reference to the accompanying drawings, wherein:

FIG. 1 is a schematic side view of three vehicles travelling along a track, one after the other and showing a slotted hollow conductor arranged below the track; and FIG. 2 is a schematic sectional view through the hollow slotted conductor with a signal flow barrier immersed into the hollow conductor.

DETAILED DESCRIPTION OF PREFERRED EXAMPLE EMBODIMENTS AND OF THE BEST MODE OF THE INVENTION

FIG. 1 shows a plurality of vehicles 1, 2, and so forth which move on a track 11. These vehicles may, for example, form part of a so-called individual public transportation system for local passenger travel, whereby each vehicle travels primarily without stopping and automatically between a starting station and a terminal station. If these vehicles 1, 2, and so forth and further vehicles not shown, but travelling on the same track 11 all travel with the same speed a collision would not be possible. The spacing between adjacent vehicles could then be very small, for example, corresponding to the absolute or minimum stopping distance. However, under most operating conditions it is not possible to maintain the same speed for all vehicles. For example, it is possible that a disabled vehicle blocks the track 11. Thus, it is necessary that all vehicles 1, 2, and so forth comprise an arrangement for the fail-safe recognition of vehicles present on the same path.

In FIG. 1 a signal, or signals, is supplied into the transmission line 21 by means of a transmitter 22 located at the terminal station of the track 11. The terminal station is not shown. Thus, the signal propagation in the transmission line or medium 21 is in the direction 25 opposite to the travel direction 20.

As shown in FIG. 1 each vehicle 1, 2, and so forth is equipped with a signal propagation blocking means 30 which is operatively secured to its respective vehicle and acts passively in response to a vehicle becoming disabled. Such passive action involves immersing the blocking means 30 into the transmission line or medium 21 which is provided with a longitudinal slot 21' whereby the blocking means 30 acts as a signal propagation barrier when it reaches into the slot 21' as best seen in FIG. 2. The signal blocking means 30 may have the shape of a rectangular plate which dips downwardly into the transmission line 21. Each vehicle 1, 2, and so forth is equipped with a signal receiver 23 which is operatively coupled with the transmission line 21 by means of a signal probe 24.

If no defective vehicle is present on a path or track section up ahead, each receiver 23 receives the signal or signals through the coupling probe 24. However, if a vehicle becomes disabled the blocking means 30, acting as a damper automatically dips into the transmission line 21, thereby causing such a damping that the next following vehicle cannot receive a signal. In FIG. 1 the vehicle 2 is disabled and the next following vehicle "i" will fail to receive the respective free signal in its receiver 23, thereby receiving an indication that the line or track ahead of the vehicle "i" is "busy".

The blocking or barrier 30 dips into the slotted hollow conductor or transmission line 21 at the location where the maximum electrical field strength is effective. If the barrier 30 is a plate of conducting material a short circuit is caused. If the device 30 is made of an electrically absorbing material, the electrical field lines are absorbed. By these features a damping in the range of 20 to 30 dB has been achieved.

Instead of equipping each vehicle with a signal receiver 23 and a coupling probe 24 it is also possible according to the invention to place a receiver at each starting station of a track or track section opposite the terminal station, whereby all vehicles in this track or track section would also be stopped.

As shown in FIG. 2, the transmission line 21 has a substantially rectangular cross-section with the slot 21' extending substantially centrally into the hollow transmission line. However, the invention is not limited to a hollow transmission line having a rectangular cross-sectional shape. It has been found that slotted hollow conductors having a trapezoidal cross-section or a triangular cross-section or an elliptical cross-section or even a circular cross-section may also be successfully used. Any of these hollow conductors will be arranged so that the slot 21' extends substantially in parallel to the path or track or lane and in such a position that the probe 24 as well as the barrier 30 may cooperate with the transmission line. Thus, if desired, the plate may reach laterally or upwardly into the transmission line when a vehicle becomes disabled. Similarly, the probe 24 may reach laterally or upwardly into the transmission line.

The invention has been described with reference to an automated, track bound passenger traffic system in which it is essential to recognize a defective vehicle on a track or track section. However, the invention is not limited to such a utilization. For example, the invention may also be advantageously used in connection with machine tools, assembly lines, and so forth. In such instances, the object recognition does not need to be limited to a breakdown or defect situation. For example, if the blocking or barrier 30 is immersed into the transmission line during the normal operation it is possible to signify the track section through which a vehicle or object is presently travelling.

Although the invention has been described with reference to specific example embodiments, it will be appreciated, that it is intended to cover all modifications and equivalents within the scope of the appended claims.

What is claimed is:

1. A method for detecting a defective object among a plurality of objects travelling along fixed path means in a given travel direction, comprising the following steps:

(a) providing a signal transmission medium along the fixed path means;

(b) transmitting at a transmission point one or more signals along said transmission medium in a transmission direction opposite to said given travel direction;

(c) normally receiving said signal or signals by receiver means installed at least at one point downstream of said transmission point as viewed in said transmission direction;

(d) providing each object with a signal interrupting means for interrupting the signal or signals on said transmission medium; and (e) substantially interrupting the signal or signals on said transmission medium by said signal interrupting means in response to a defect in any one of said objects.

2. The method of claim 1, further comprising dividing said fixed path into a plurality of path sections whereby a defective object prevents only the signal reception by objects following the defective object in the respective path section.

3. The method of claim 1 or 2, comprising providing each of said objects with its own signal receiver.

4. The method of claim 1, wherein said step of substantially interrupting the signal or signals comprises damping the signal or signals on said signal transmission medium at the location of a defective object to such an extent that any signal reception downstream of said defective object as viewed in said transmission direction is substantially interrupted.

5. An apparatus for detecting a defective object among a plurality of objects travelling along fixed path means in a given travel direction, comprising transmission means (21) installed along said fixed path means, transmitter means operatively connected to said transmission means for propagating a signal or signals in a transmission direction extending along said transmission means and opposite to said travel direction, signal interrupting means installed on each of said objects, signal receiving means installed downstream of said transmitter means for normally receiving said signal or signals when all objects on the path means are operational, said signal interrupting means substantially interrupting the signal reception downstream of a defective object as viewed in said signal transmission direction when said signal interrupting means are activated in response to an object becoming defective.

6. The apparatus of claim 5, wherein said transmission means is a hollow conductor (waveguide) having a longitudinal slot therein extending substantially in parallel to said fixed path means, said signal interrupting means comprising signal damping means adapted to dip into said longitudinal slot in response to an object becoming defective, whereby said damping means in its dipped-in position sufficiently damp the signal or signals to interrupt the signal reception.

7. The apparatus of claim 6, wherein said signal receiving means comprise individual receivers installed on each object and signal sensing probe means reaching into said longitudinal slot and operatively connecting the respective receiver to the transmission means.

8. The apparatus of claim 6 or 7, wherein said signal damping means comprise plate means operatively connected to each object and shaped for dipping into said longitudinal slot.

9. The apparatus of claim 8, wherein said plate means are made of electrically conducting material, for example aluminum.

10. The apparatus of claim 8, wherein said plate means are made of electrically absorbing material, for example carbon in flexible plastic reinforced by glass-fiber plates.

11. The apparatus of claim 5, wherein said transmission means comprise a plurality of separate sections.

* * * * *